United States Patent [19]

McClure

[11] 3,997,686

[45] Dec. 14, 1976

[54] ORNAMENT AND METHOD OF MANUFACTURE

[76] Inventor: Stewart McClure, 4501 E. Charles Ronald Ave., Las Vegas, Nev. 89121

[22] Filed: Oct. 16, 1974

[21] Appl. No.: 515,321

[52] U.S. Cl. ..... 427/4; 63/2; 63/23; 63/32; 156/57; 427/290; 427/316; 427/346; 427/385 R; 427/386; 428/15; 118/56; 118/500

[51] Int. Cl.[2] ..... A01N 3/00

[58] Field of Search ..... 63/1, 2, 23, 32; 428/15, 290; 156/57; 427/4, 316, 346; 426/1; 35/20

[56] References Cited

UNITED STATES PATENTS

| | | | |
|---|---|---|---|
| 2,169,811 | 8/1939 | Nevison | 35/20 |
| 2,879,583 | 3/1959 | Booth et al. | 427/346 X |
| 2,887,746 | 5/1959 | Bogoff | 63/26 UX |
| 2,917,856 | 12/1959 | Soloff | 428/15 X |
| 3,122,900 | 3/1964 | Beghetto | 63/23 |
| 3,607,488 | 9/1971 | Yordan | 427/4 X |

*Primary Examiner*—F. Barry Shay
*Attorney, Agent, or Firm*—Jerry R. Seiler

[57] ABSTRACT

An ornament is produced by drying an animal dropping, removing the natural outer coating to expose the interior grain and treating the dropping with a plastic or synthetic resin to form a hard transparent coating. The resulting product is an ornament that can be used to form a necklace, brooch, cuff links or other attractive jewelry piece.

3 Claims, 6 Drawing Figures

ORNAMENT AND METHOD OF MANUFACTURE

BACKGROUND AND SUMMARY OF THE INVENTION

It has been found that an attractive jewelry piece which has a variety of such uses and of which jewelry is obviously an interesting conversational piece comprises a rather small animal dropping in which the outer layer has been removed. The exposed interior grain, when soaked and coated with a transparent synthetic resin which cures to a hard dry surface offers an attractive product. Accordingly, it is an object of the invention to provide an attractive ornament which can be secured on a neck chain to form a necklace or secured to other supports to form an earring, brooch, cuff link or the like. It is also an object to provide an interesting and controversial jewelry piece which is rather simple and inexpensive to manufacture. These as well as other objects will be evident from the following detailed description.

DETAILED DESCRIPTION OF THE INVENTION

The ornaments of the invention are produced from the droppings or dung of animals. In particular, those droppings which are of a suitable size so that they can be easily manufactured into an ornament having a length of no greater than about 2 inches and normally less than about one and one-half inches are particularly suitable. Larger droppings may be more difficult to process as well as being less acceptable for jewelry pieces because of their size. Accordingly, droppings from antelope, rabbit, big horn sheep, porcupine, deer, moose and elk are particularly desirable. Moreover, the droppings of these animals are also highly preferred because it contains a large amount of roughage or undigested materials such as grass, hay, plant leaves and stems, and forms an attractive grain pattern which it is desirable to expose in achieving an ornament of the invention. As used herein, a grain surface is meant to define the usually multi-colored appearance having a mixture of various lighter and darker shreds and particles, often in tans, yellows, grays and browns.

In first treating the droppings, they are to be dried so that at least a major amount of the moisture is removed by evaporation thereby making the article lighweight and substantially free from odor and further deterioration. However, because of the large and extensive amount of roughage in the form of grasses, hay, leaves, stems and other high fiber content and coarse foods which are chewed and injested by the animal and thereby form a major amount of the bulk of the dropping. These fiber particles form the grain and give the color to the interior of the dropping beneath the outer layer or crust. Moreover, once the large amount of water or moisture has been removed, the size of the dropping is not significantly reduced, again, because of the great amount of undigested fiber content which remains in the dropping. However, it will be appreciated that when the moisture or water has been removed, the weight will be significantly reduced and the dropping will become hardened so that it can be treated and handled with less danger of being easily crushed.

The drying phase may be achieved by simply allowing the droppings to lie exposed to relatively dry air for a sufficient amount of time to allow the desired amount of moisture to become naturally evaporated. The presence of heat will also assist in more rapid evaporation of the moisture. In some instances where the droppings have been exposed to naturally dry conditions for any length of time, the natural droppings themselves may be sufficiently dry so as to require little if any further drying. In other cases however, especially where the droppings are relatively fresh, they will need to be exposed to drying conditions as will be understood by those skilled in the art.

Figure 1:
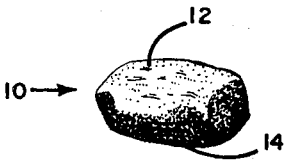
FIG. 1 is a perspective view of a dropping having a portion of the natural outer coating removed to expose the interior grain surface.
Figure 2:
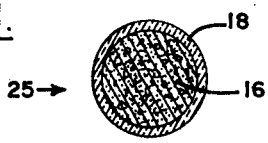
FIG. 2 is a sectional view of a treated ornament of the invention having a hardened synthetic resin coating.

Following the drying phase, the droppings are to be treated to remove the natural outer crust or layer in order to expose the lighter colored grain surface and which grain actually gives the final ornament its desirable appearance. Normally, the natural outer crust or layer is rather dark often almost black and has little, if any, overall grain appearance. This natural outer layer is usually relatively thin and can be removed by hand such as by picking or chipping. However, it is preferably removed by sanding or using other abrasive means. The sanding can be carried out by hand utilizing sandpaper or an electric sander can be used, for example, an electrical drill or similar type of device having a rotating sander surface. Alternatively, a rock polisher incorporating a rotating can or drum in which is exposed a sand, grit or other abrasive material and in which drum the dropping can be placed to remove the outer shell, crust or surface. Preferably, regardless of which method is used, the dropping is to be retained in its natural shape so that only the crust is removed and which will expose the inner and usually lighter colored grain surface. Again, with only the outer surface removed the dropping will still have its original shape and be only slightly smaller in size. However, where desired, the operator can reshape the dropping somewhat by sanding or otherwise abrading more of any surface desired to achieve the final shape and size. However, where the droppings are between about one-half to about one inch in length along their elongated axis or at their greatest dimension, it will be of a suitable size for most ornamental jewelry pieces including necklaces, brooches, cuff links and the like. Even the smaller droppings may be further sanded or abraded to achieve the required size. FIG. 1 illustrates a dropping 10 in which the natural outer crust 14 has been partially removed to expose the interior grain surface 12 which gives the ornament its attractive appearance.

Following removal of the outer layer or crust, the more attractive grain surface is exposed substantially completely around the dropping and which is then ready for treatment and coating with a synthetic resin. The resin treating and coating step is carried out by simply dipping the sanded and exposed grain surfaced dropping in a liquid synthetic resin. Dipping is conveniently carried out by inserting a needle, pin or other relatively thin shaft into one end of the dropping and simply then dipping the dropping into the liquid resin. This may be done by hand utilizing a device illustrated in FIG. 3 or automatically on a production basis utilizing a device having a plurality of needles or pins exposed around an outer edge or surface and on which needles are secured droppings. This device can then be dipped into a liquid synthetic resin bath. Any other suitable apparatus or means for dipping the droppings into the resin may be used and those discussed and disclosed herein are by way of illustration and example only and the invention is not to be so limited.

Figure 3:
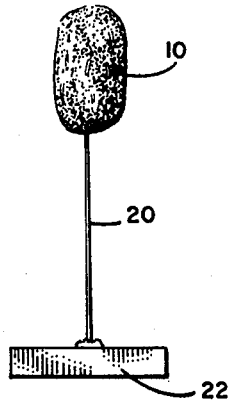
FIG. 3 illustrates the dropping secured on a device for dipping the article into liquid resin and for its support during resin curing.

Observing FIG 3, a device for hand dipping includes a pin or shaft 20 which extends somewhat into the dropping 10 sufficient to hold it onto the end of the shaft. A base member 22 may be of assistance in grasping the device easily during the dipping process and in which base may be incorporated a magnet for assistance in conveniently drying and curing the resin as will be explained hereinafter.

The type of resin to be used is critical in that in order to expose the natural grain on the finished ornament, the resin must dry to a clear, transparent and preferably colorless coating, also which preferably has a high gloss finish so as to give lustre and brilliance on the exterior surface of the ornament. Any number of synthetic resin plastics may be used for example, epoxy resin, polycarbonates, acrylic and polyester resins. Specific resins within these groups used for coating and which are readily commercially available are so well known to those skilled in the art that further description is not required. The epoxy resins utilize both a curing agent and a poly epoxide in liquid form which are mixed, usually in equal volumes, and cure to a very hard, clear, transparent and colorless coating. Other resins include the polycarbonates, acrylics and polyesters which are available commercially and which can also be readily cured, preferably at ambient conditions and may be used and selected by those skilled in the art.

Certain varnishes or lacquers may also be used, but preferably are those which will form a sufficient coating while exposing the grain surface but without the dropping surface itself being physically exposed, other than by being viewed through the coating. The purpose of this is both for esthetic reasons as well as to have a sufficient outer coating to protect the dropping itself which would otherwise deteriorate somewhat or become damaged. Thus, the synthetic resin materials such as the varnishes or lacquers, since the latter do not form strong coating surfaces as do the resin disclosed herein. For example, epoxy resin when cured forms an extremely hard and yet clear, transparent surface thereby protecting the ornament and giving it a long and lasting life. Such an advantage will be readily appreciated.

The resin may be required to be dipped a number of times especially where the dropping is quite dry since it will absorb significant amount of the liquid resin material. Such absorption of the material is not undesirable since it will strengthen the product and also because it will wet the exposed surface. This wetting will significantly bring out the grain surface much like oiling a natural wood surface whereby the various colors, shades and patterns are much more visible and are easily distinguished. Each coating or dipping may be dried or cured to the desired extent, at least until the resin has "set up" so that it no longer will run or drip. The operator may also examine the ornament to determine whether or not additional coating is required to achieve the desired thickness and surface qualities of the coating.

Figure 4:
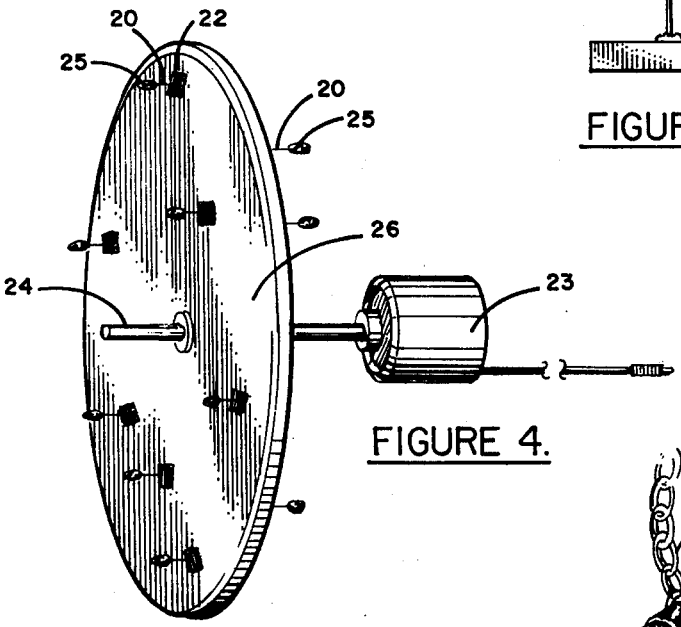
FIG. 4 illustrates a rotating plate apparatus used during resin curing of the coated article.

As soon as the dropping has been dipped in liquid resin, it is removed and the resin is allowed to cure. In order to obtain a uniform coating, and to prevent or at least reduce the amount of running and dipping of the resin, it is found desirable to rotate the ornament until the resin sets up or cures sufficiently so that it no longer runs or drips on standing. This is best accomplished by allowing the dropping to rotate in a vertical plane with its elongated axis extending normal to the vertical plane or horizontal. This method is observed in FIG. 4 whereby a plate 26 extends vertically or substantially vertically and has a shaft or axle 24 extending substantially at the center of the plate and about which it will rotate. One end of the shaft is attached to a drive of motor 23, which may be variable speed, so that the motor will turn or rotate the plate at any desired rate. Speeds of between about 10 and about 60 revolutions per minute are desirable for preventing most liquid resins running while speeds of between about 25 and about 40 rmp are more preferred. It is most convenient to secure the ornament on the rotating plate or wheel as illustrated in FIG. 4 utilizing a magnet base 22 (note FIG. 3) which will be attracted to the plate 26. In this manner, the ornament 10 as shown in FIG. 3 can be dipped in the liquid resin and then immediately secured on the plate as shown in FIG. 4.

During the drying operation on the rotating plate, it is preferred that the dropping have its elongated axis extending horizontally while the plate rotates vertically. In this position, the resin will tend to be held at and around the outer sides of the dropping and will not run along the rod or drip from the ends of the dropping as it would if the dropping were allowed to stand as in a position of FIG. 3. Thus, with the resin being held along the side gravitationally and centrically as the plate rotates, its thickness will be maintained uniformly around the dropping sides as it begins to set up and harden. It will also yield a somewhat thicker coating along the sides as compared to the ends which thickness gives the ornament a much deeper, richer and attractive appearance as it is viewed through the thicker coating area. The coating will be uniform, even, and the outer surface will be free of blemishes, creases and run lines which is obviously most desirable.

Figure 5:
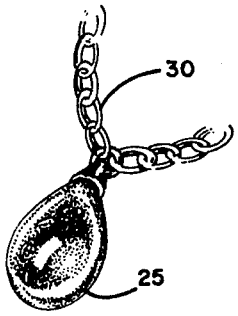
FIG. 5 shows a necklace incorporating an ornament of the invention.
Figure 6:
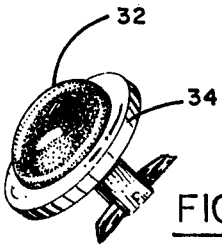
FIG. 6 illustrates a cuff link incorporating an ornament of the invention.

Once the resin has began to set up so that it will no longer run and has become somewhat hardened, the ornament can be readily removed by simply pulling the magnetized base 22 away from the metal plate 26 and the article may be allowed to stand until curing is complete. At that time, the ornament can be removed from the pin and then made into jewelry as desired. Two jewelry articles are illustrated in FIG. 5 and 6, the first being a necklace with ornament 25 being secured on a necklace 30 and in FIG. 6, with ornament 32 secured on a cuff link base 34. In the latter case, the original dropping was sanded or shaped so that it was only approximately one-half of its original size as if it were cut along its elongated axis and was then coated and treated as previously described. The method of securing the treated dropping to a component to form a piece of jewelry is not critical and usually adhesive or other glueing or even use of an additional small amount of synthetic resin may be utilized. Any form of jewelry including tie tacks, earrings, necklaces, brooches, key rings, medallions, paperweights, cuff links, and the like may be produced incorporating an ornament of the invention. It will be understood that other uses of such ornaments are within the purview of the invention as will be understood by those skilled in the art.

I claim:

1. A method of producing an ornament comprising:

a. drying an animal dropping;

b. contacting the dropping with an abrasive material to remove the natural outer coating therearound to expose the interior grain surface;

c. immersing the dropping in a liquid resin to form a resin coating thereon; and d. curing said resin while rotating said resin coated dropping along a vertical plane with the elongated axis of said dropping extending normal to said plane to form a hard, transparent coating.

2. The method of claim 1 wherein said resin is selected from the group consisting of epoxy, polycarbonate, acrylic and polyester resins.

3. The method of claim 1 wherein said rotation is accomplished by securing said dropping on a vertical plate member being rotated at between about 10 and about 60 revolutions per minute.

* * * * *